United States Patent [19]

Cochran

[11] 4,074,942

[45] Feb. 21, 1978

[54] COMPACTOR WHEEL WITH CROSS-SHAPED TIPS

[75] Inventor: Thomas E. Cochran, Yorkville, Ill.

[73] Assignee: Caterpillar Tractor Co., Peoria, Ill.

[21] Appl. No.: 729,526

[22] Filed: Oct. 4, 1976

[51] Int. Cl.[2] ..... E01C 19/26

[52] U.S. Cl. ..... 404/121; 404/124; 301/41 R; 172/540

[58] Field of Search ..... 404/124, 121, 90; 301/41 R, 43, 44 R, 44 B; 172/540, 554

[56] References Cited

U.S. PATENT DOCUMENTS

| | | | |
|---|---|---|---|
| 391,740 | 10/1888 | English | 301/43 |
| 654,049 | 7/1900 | Bettendorf | 301/43 |
| 880,122 | 2/1908 | Bucey | 301/43 |
| 1,234,075 | 7/1917 | Optiz | 301/44 R |
| 1,673,184 | 6/1928 | Cady | 404/121 X |
| 1,930,615 | 10/1933 | Harris | 301/44 R |
| 1,964,889 | 7/1934 | McCormick | 301/44 B |
| 2,911,893 | 11/1959 | Archibald | 404/124 |
| 3,463,063 | 8/1969 | Caron | 404/124 |
| 3,656,418 | 4/1972 | Lutz | 404/121 |
| 3,853,419 | 12/1974 | Bertram | 404/121 |

*Primary Examiner*—Nile C. Byers
*Attorney, Agent, or Firm*—Phillips, Moore, Weissenberger, Lempio & Majestic

[57] ABSTRACT

A compactor wheel comprises sets of tips each disposed in circumferential alignment therearound with the leading edge of a tip of one set being substantially aligned with the trailing edge of a tip of an adjacent set. Each tip comprises a body portion having a cross-shaped tip portion secured in upstanding relationship thereon to include a first tip portion extending circumferentially and a second tip portion extending transversely relative to the first tip portion and disposed intermediate the ends thereof. A tapered surface and concavity are formed on each lateral side of the first tip portion to dispel material outwardly therefrom during compaction of soils or the like. A plurality of circumferentially aligned blades are positioned on each lateral side of the compactor wheel.

12 Claims, 4 Drawing Figures

Fig-1-
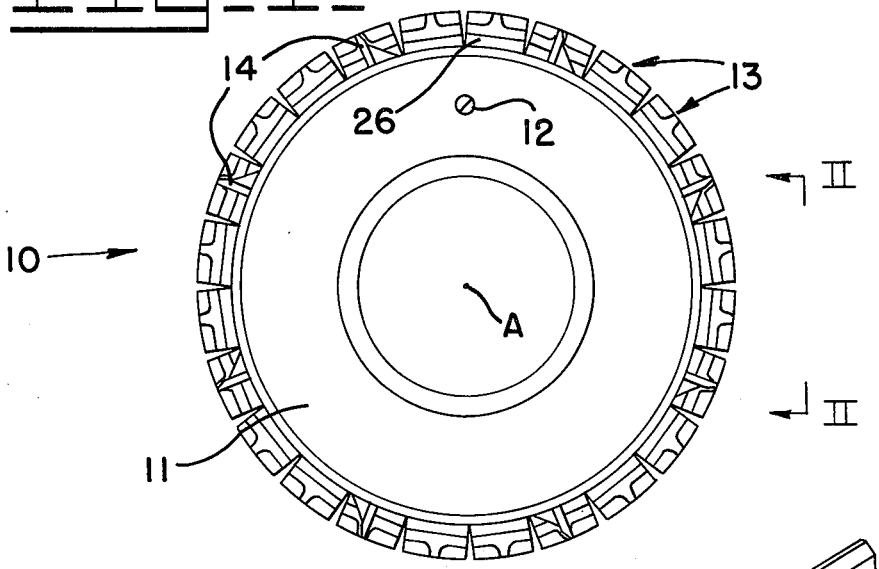
Fig-2-
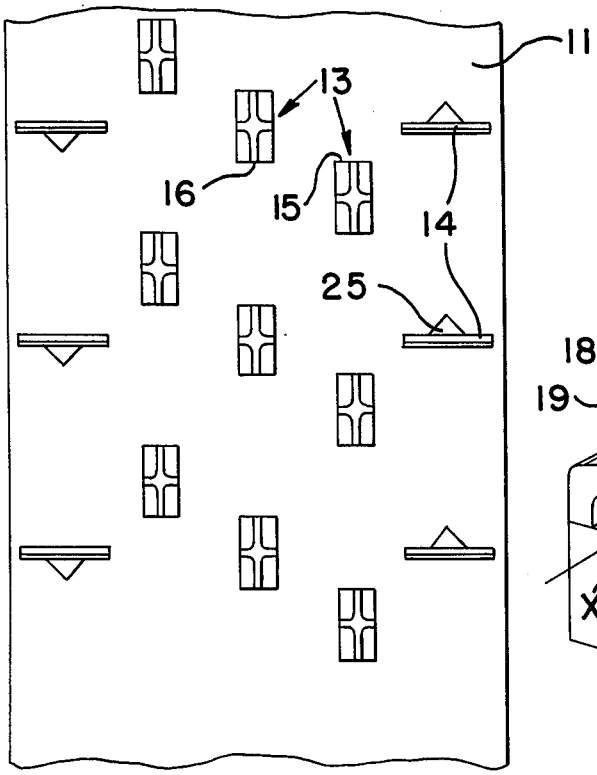
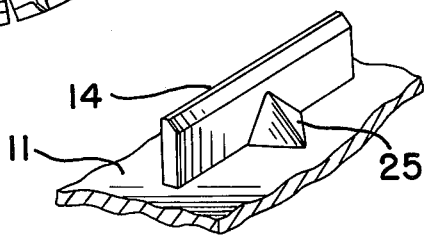
Fig-4-
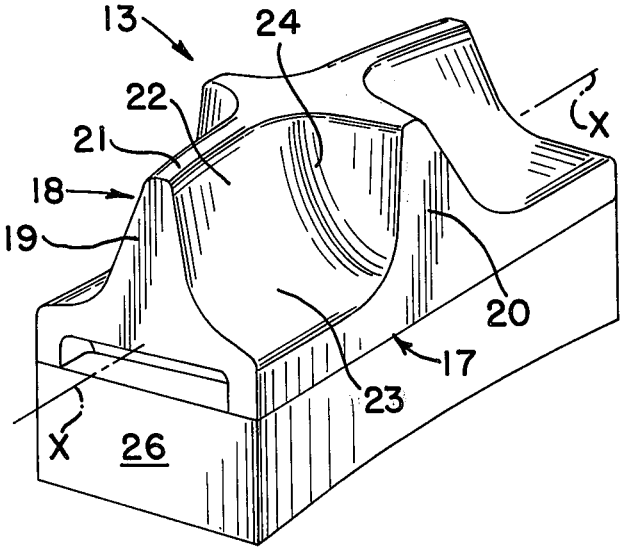
Fig-3-

COMPACTOR WHEEL WITH CROSS-SHAPED TIPS

BACKGROUND OF THE INVENTION

Compactor wheels are normally employed on vehicles used in sanitary land fill operations wherein the soil must be compacted to provide dense layers therein. The tips and/or blades employed on the compactor wheel oftentimes become clogged and thus do not perform efficiently. The clogging and related problems are fully discussed in U.S. Pat. Nos. 3,687,023 and 3,853,419, both assigned to the Assignee of the subject application. In addition, the arrangement of standard tips and blades oftentimes does not induce a smooth ride and also distracts from the tractive capabilities of the vehicle.

SUMMARY OF THE INVENTION

An object of this invention is to provide an improved compactor tip for compactor wheels which is adapted to be self-cleaning and further exhibits high degrees of structural integrity and work efficiency. The compactor tip comprises a body portion having a generally cross-shaped tip portion secured in upstanding relationship thereon. The tip portion includes the first tip portion adapted to extend circumferentially on a compactor wheel to which it is secured to provide sideslope tractive capabilities. A second tip portion extending transversely relative to the first tip portion and disposed between the ends thereof to provide forward-reverse tractive capabilities. The tips so disposed also provide a high degree of chopping and compactive action.

In the preferred embodiment of this invention, at least the outboard surface portions of the first tip portion are tapered downwardly and outwardly to terminate at a concavity to impel compacted soils and the like outwardly away from the compactor wheel. In addition, the tips are preferably disposed in a plurality of sets with each set being circumferentially aligned about the compactor wheel with the leading edge of each tip of one set being at least substantially aligned with the trailing edge of a tip of an adjacent set.

Such arrangement provides a substantially constant rolling radius which increases the smooth ride capabilities of the compactor wheel. Furthermore, a set of circumferentially aligned blades are preferably secured on each lateral side of the compactor wheel to cooperate with the tips to chop-up debris and the like which is mixed with the soil or underfooting of the compactor wheel. The blades further function to increase the overall traction capabilities of the compactor wheel.

BRIEF DESCRIPTION OF THE DRAWING

Other objects of this invention will become apparent from the following description and accompanying drawing wherein:

FIG. 1 is a side elevational view of a compactor wheel embodying this invention;

FIG. 2 is an enlarged plan view, taken in the direction of arrows II—II in FIG. 1, illustrating sets of compactor tips and blades secured on the compactor wheel;

FIG. 3 is an enlarged isometric view of one of the compactor tips; and

FIG. 4 is an enlarged isometric view of one of the blades.

DETAILED DESCRIPTION

FIG. 1 illustrates a compactor wheel 10 adapted for mounting on a drive axle of a compactor vehicle in a conventional manner. The compactor wheel may comprise an annular rim or drum 11 having a fill plug 12 removably attached thereto to at least partially fill the closed rim with a ballast, such as water. A plurality of compactor tips 13 and blades 14 are secured on the periphery of the rim by conventional welding techniques or the like.

Referring to FIG. 2, three sets of compactor tips 13 are illustrated with each set being disposed in circumferential alignment about the compactor wheel. As further illustrated, a leading edge 15 of a compactor tip of one set is at least substantially aligned in a transverse direction relative to a trailing edge 16 of a tip of an adjacent set. In the embodiment illustrated, two sets of blades 14 are provided with each set being disposed in circumferential alignment about the compactor wheel and further disposed adjacent to a respective lateral side thereof.

Referring to FIG. 3, each compactor tip 13 comprises a body portion 17 having a generally cross-shaped tip portion 18 secured thereon in upstanding relationship. The tip portion comprises a first tip portion 19 extending in the direction of a longitudinal axis X of the compactor tip and circumferentially on the compactor wheel when secured thereto. This construction and arrangement provides good side slope tractive capabilities, i.e., the machine will not be as prone to sideways sliding movements during operation on a slope or hill. A second tip portion 20 extends transversely and preferably perpendicular relative to first tip portion 19 and is disposed intermediate the ends thereof. Tip portion 20 will aid blades 14 in tractive effort in the forward-reverse directions of travel of the machine.

An upper surface or chopping edge 21 of first tip portion 19 is arcuate and preferably comprises a segment of a circle defined by a radius having its center at the rotational axis A of compactor wheel 10 (FIG. 1). Each of the inboard and outboard surface portions 22 of tip portion 19 are tapered downwardly and outwardly to merge with compaction surface portions 23. Surface portions 22 and 23 define a concavity therebetween for impelling materials outwardly from the compactor tip for self-cleaning purposes. In addition, each of the four corners of intersection between tapered surface portions 24 of tip portion 20 and surface portions 23 defines another concavity to further aid in the self-cleaning function. It should be further noted that each end of tip portions 19 and 20 thus forms a generally inverted V-shaped construction.

Each tip 13 is preferably secured to the outer surface of a base member 26. The base members can be welded or otherwise suitably secured to the periphery of drum 11 to form a permanent art thereof. The base members adapt the tips for replacement purposes and aid in increasing the compaction capabilities of the compactor wheel by having the weight of the machine substantially supported on the ground-engaging areas of the tips rather than on the total drum area.

Referring to FIG. 4, each blade 14 is secured on the periphery of rim 11 of the compactor wheel by a gusset 25 which is preferably welded thereto. Each blade extends radially outwardly from the rim in perpendicular relationship relative to longitudinal axis X of each compactor tip 13. It should be further noted in FIG. 2 that each blade is substantially aligned in a transverse direction with a tip portion 20 of a respective compactor tip of the intermediate set of compactor tips illustrated therein. In addition to their "chopping" function, the blades increase the overall traction capabilities of the compactor wheel.

What is claimed is:

1. A compactor wheel having a plurality of sets of circumferentially and laterally spaced separate tips secured on an uninterrupted periphery thereof, each set of tips being circumferentially aligned about said compactor wheel with a leading edge of a compactor tip of one of said sets being substantially aligned in a transverse direction relative to a trailing edge of a compactor tip of an adjacent set of compactor tips, each tip having a major longitudinal axis extending in a circumferential direction on said wheel and comprising a body portion, and a generally cross-shaped tip portion secured in upstanding relationship on said body portion and including a first tip portion extending in the direction of said axis and a second tip portion, having a length substantially less than the length of said first tip portion, extending transversely relative to said first tip portion and disposed between the ends thereof, outer surfaces formed on each lateral side of said first tip portion disposed on each side of said second tip portion being tapered downwardly and outwardly towards said body portion and means defining a concavity on said outer surfaces below said taper and merging therewith.

2. The compactor wheel of claim 1 further comprising means defining another concavity at the intersection of said taper and said first-mentioned concavity between said first and second tip portions.

3. The compactor wheel of claim 1 wherein each end of each of said first and second tip portions forms an inverted, generally V-shaped construction.

4. The compactor wheel of claim 1 wherein a radially outer surface of said first tip portion is arcuate.

5. The compactor wheel of claim 1 wherein three sets of said compactor tips are disposed on the periphery of said compactor wheel in laterally spaced relationship thereon.

6. The compactor wheel of claim 1 further comprising a plurality of blades secured on said compactor wheel in upstanding relationship thereon.

7. The compactor wheel of claim 6 wherein each of said blades is secured on said compactor wheel by a gusset welded thereto.

8. The compactor wheel of claim 6 wherein a set of said blades are disposed on each lateral side of said compactor wheel.

9. The compactor wheel of claim 8 wherein each set of said blades is disposed in circumferential alignment about said compactor wheel.

10. The compactor wheel of claim 9 wherein each of said blades is at least substantially aligned in a transverse direction with a respective one of the compactor tips of one set of said compactor tips.

11. The compactor wheel of claim 10 wherein each of said blades is at least substantially aligned with the second tip portion of a respective compactor tip of said one set of compactor tips.

12. The compactor wheel of claim 1 wherein each of said compactor tips is secured to an outer surface of a base member, said base member secured to the periphery of said compactor wheel to form an integral part thereof.

* * * * *